US008097073B2

(12) United States Patent
Jang et al.

(10) Patent No.: US 8,097,073 B2
(45) Date of Patent: Jan. 17, 2012

(54) DEHUMIDIFIER

(75) Inventors: Won-Suk Jang, Busan-si (KR); Chi-Wan Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 405 days.

(21) Appl. No.: 11/991,548

(22) PCT Filed: Nov. 1, 2006

(86) PCT No.: PCT/KR2006/004503

§ 371 (c)(1),
(2), (4) Date: Oct. 8, 2009

(87) PCT Pub. No.: WO2007/052947

PCT Pub. Date: May 10, 2007

(65) Prior Publication Data

US 2010/0293981 A1 Nov. 25, 2010

(30) Foreign Application Priority Data

Nov. 1, 2005 (KR) ..... 10-2005-0103873
Nov. 4, 2005 (KR) ..... 10-2005-0105580

(51) Int. Cl.
*B01D 59/26* (2006.01)

(52) U.S. Cl. ..... 96/108; 62/150; 62/291

(58) Field of Classification Search ..... 96/108; 62/150, 291
See application file for complete search history.

(56) References Cited

U.S. PATENT DOCUMENTS 5,884,495 A * 3/1999 Powell et al. ..... 62/150
6,471,739 B2 * 10/2002 Eom ..... 55/471
2002/0023445 A1 2/2002 Sul et al.

FOREIGN PATENT DOCUMENTS

JP 2002-317961 10/2002
JP 2003161462 6/2003
JP 2004-340460 12/2004
KR 1020040029623 4/2004

* cited by examiner

*Primary Examiner* — Robert A Hopkins
(74) *Attorney, Agent, or Firm* — McKenna Long & Aldridge LLP

(57) ABSTRACT

A dehumidifier is provided. The dehumidifier includes a base, a barrier installed on the base to divide front and rear portions of the base, a drain pan formed on an upper portion of the barrier to collect condensed water and provided with a water collecting hole through which the condensed water is discharged, a drain hose connected to the water collecting hole to discharge the condensed water, and a hose fixing unit formed on the barrier to fix the drain hose.

20 Claims, 8 Drawing Sheets

[Fig. 1]
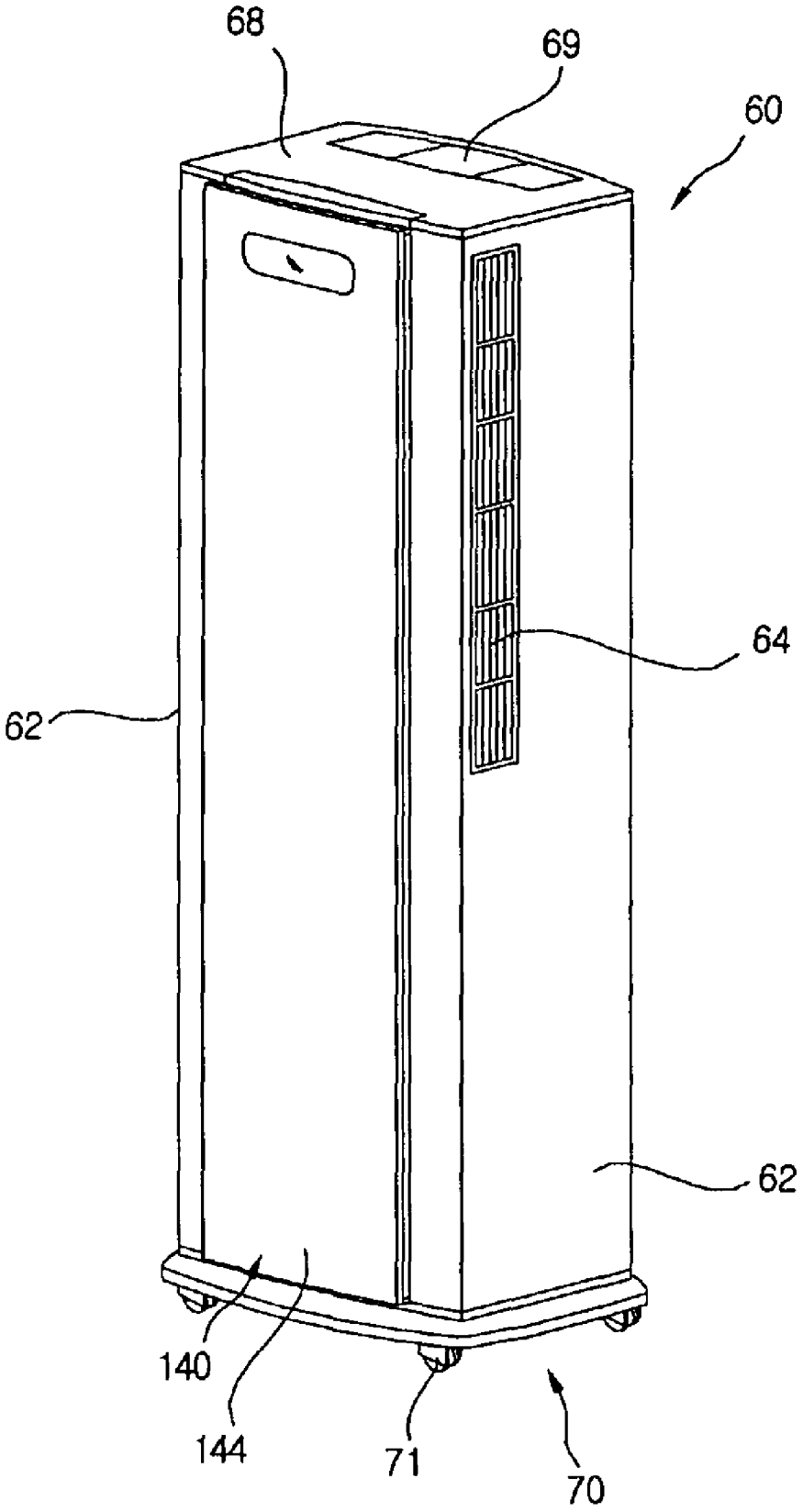

[Fig. 2]
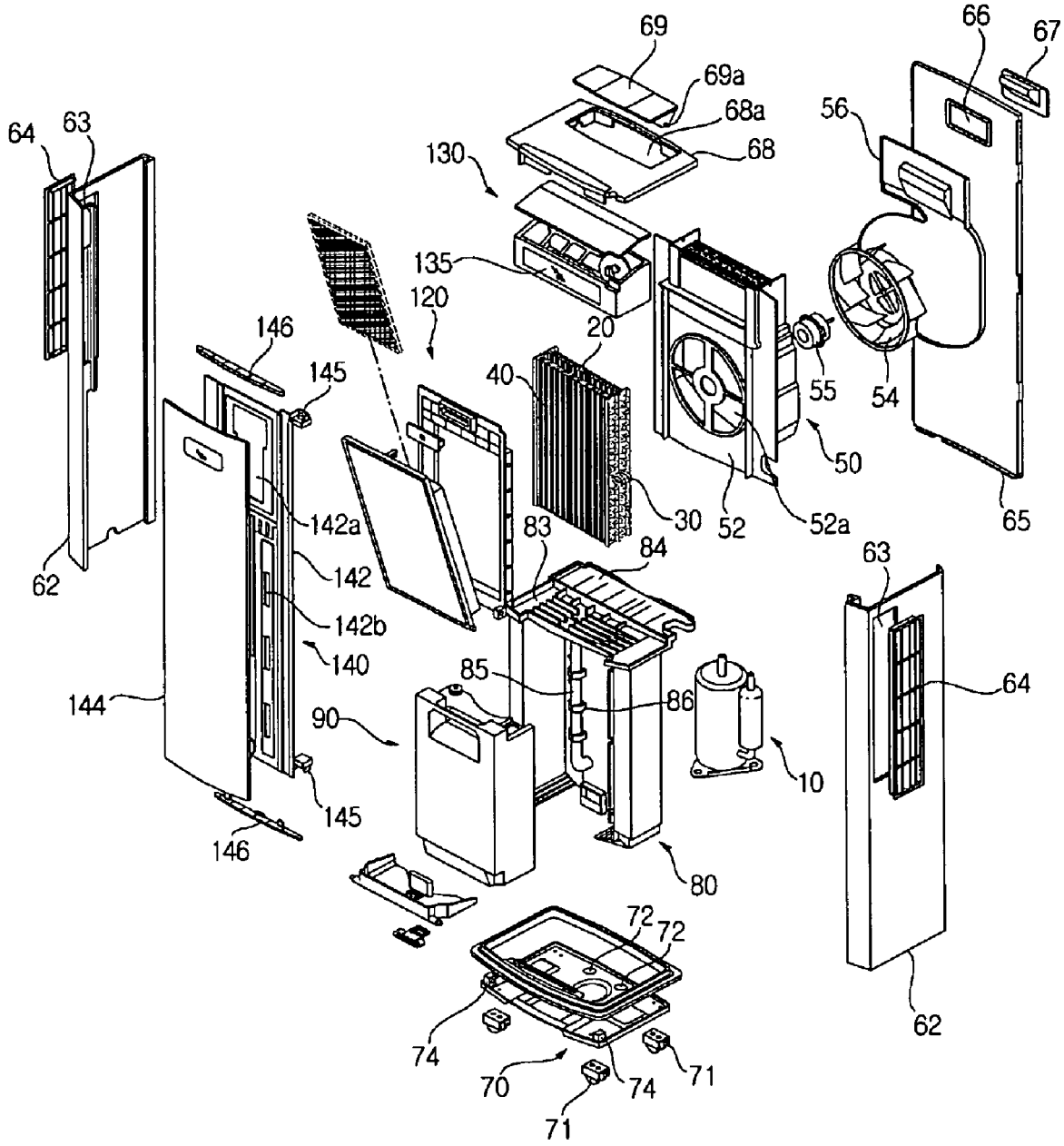

[Fig. 3]
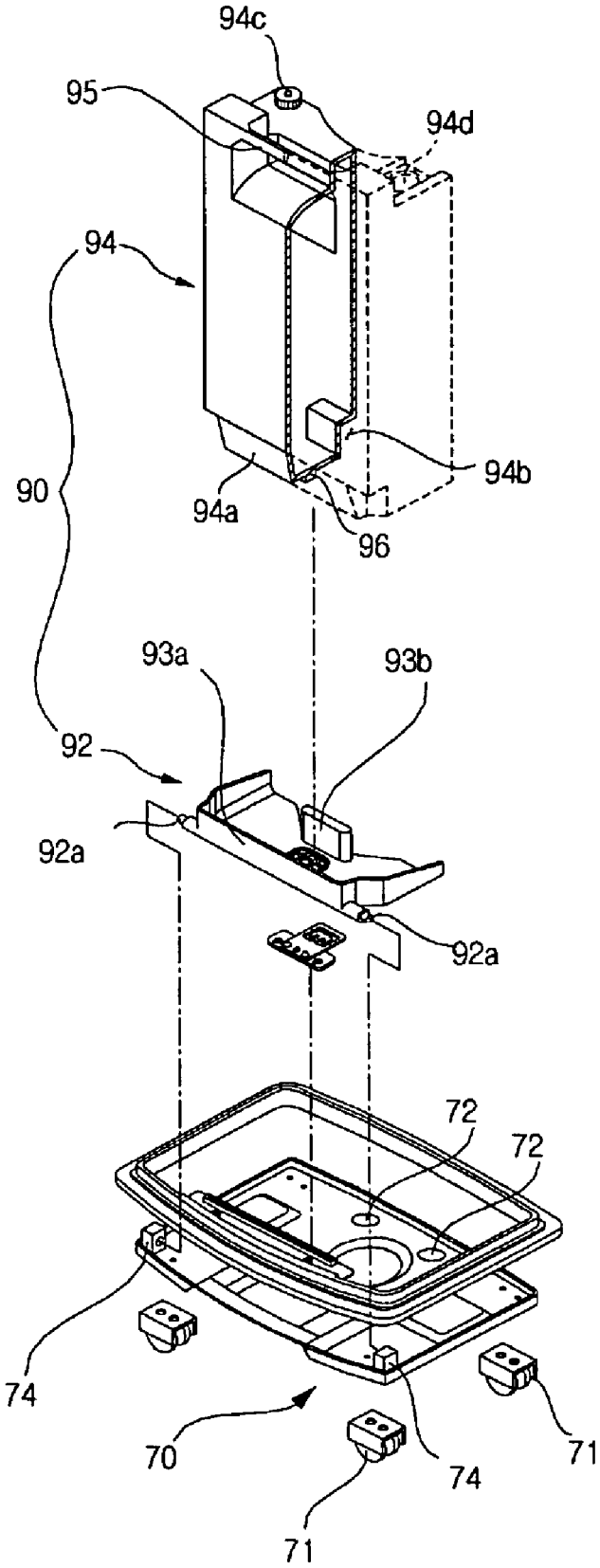

[Fig. 4]
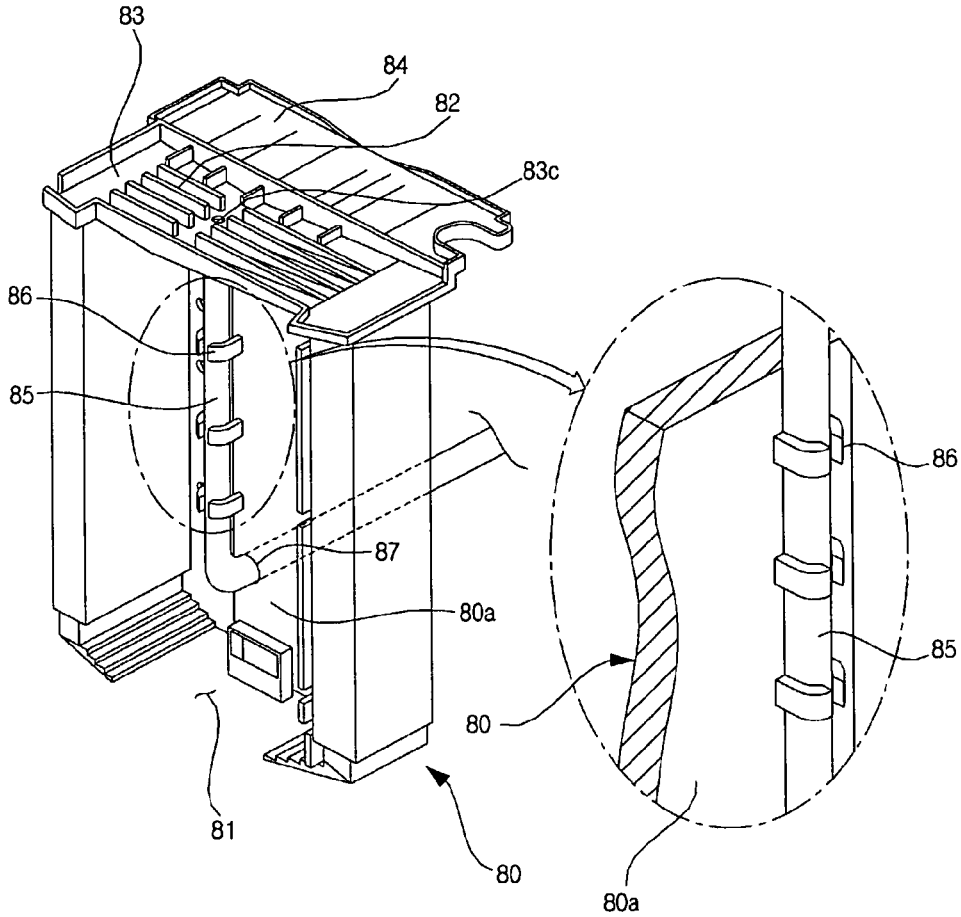
[Fig. 5]
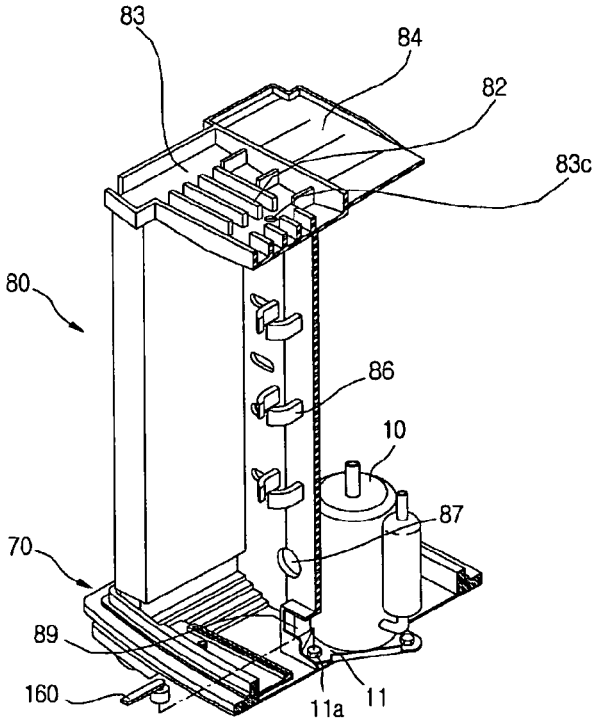

[Fig. 6]
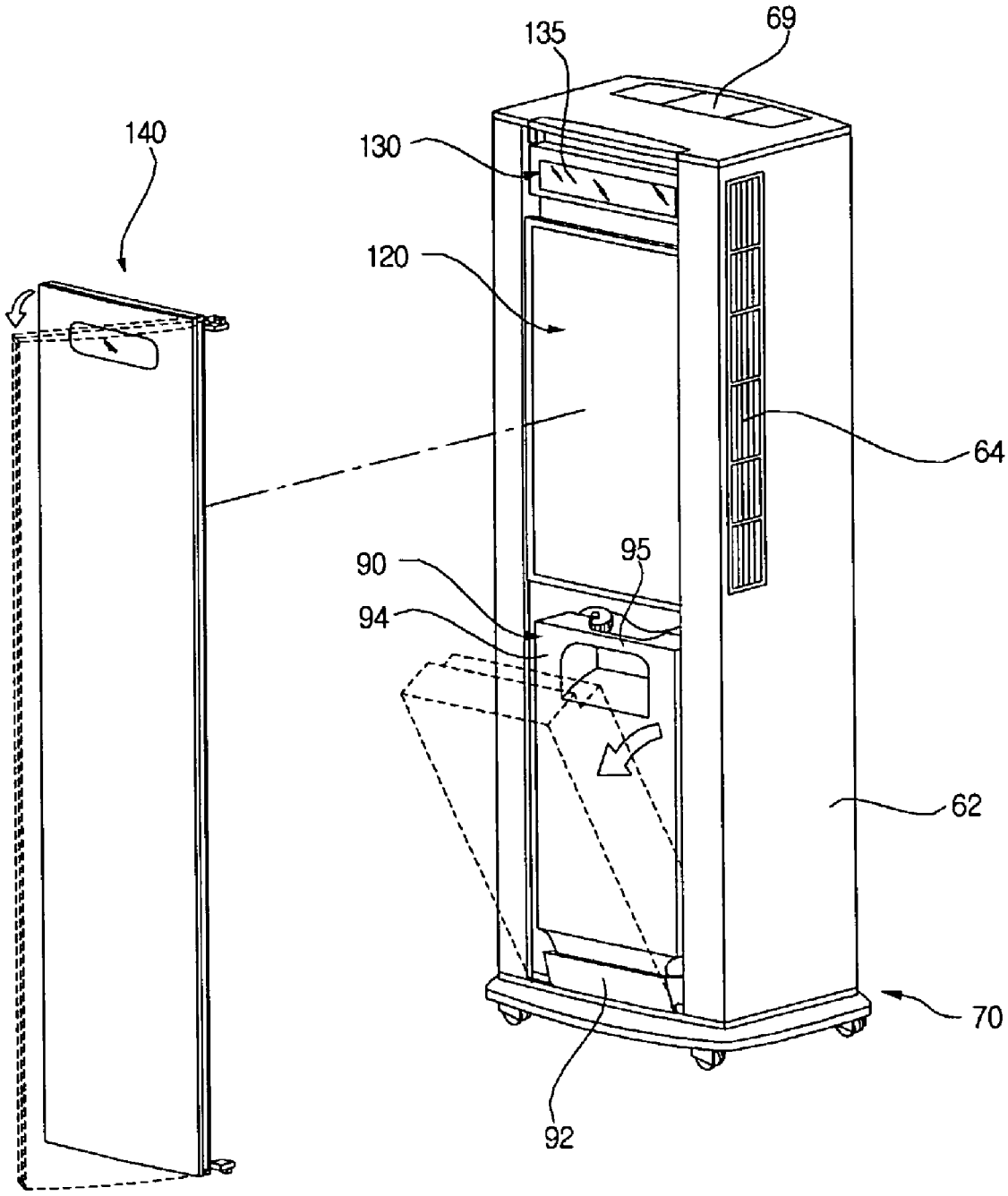

[Fig. 7]
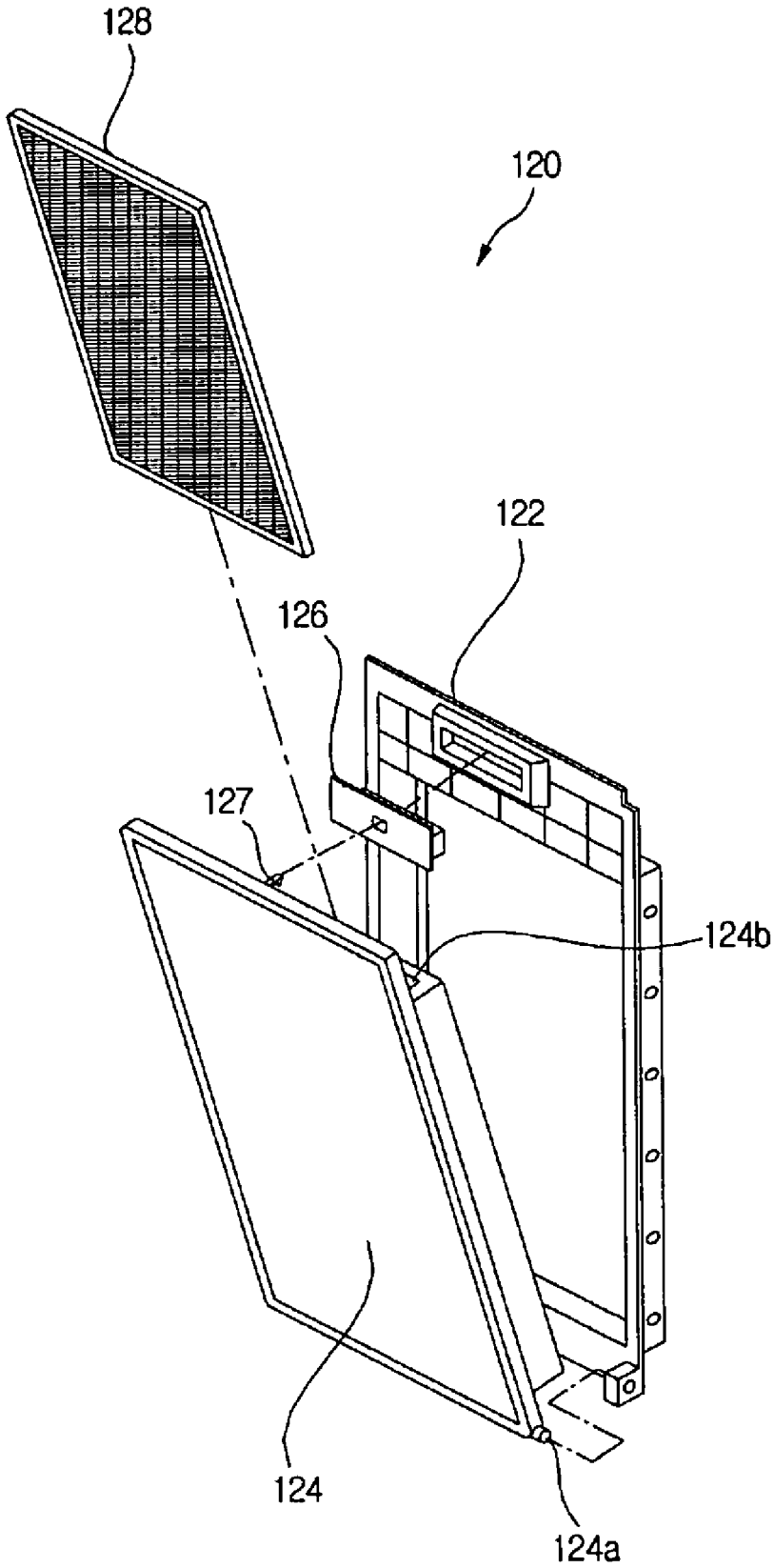

[Fig. 8]
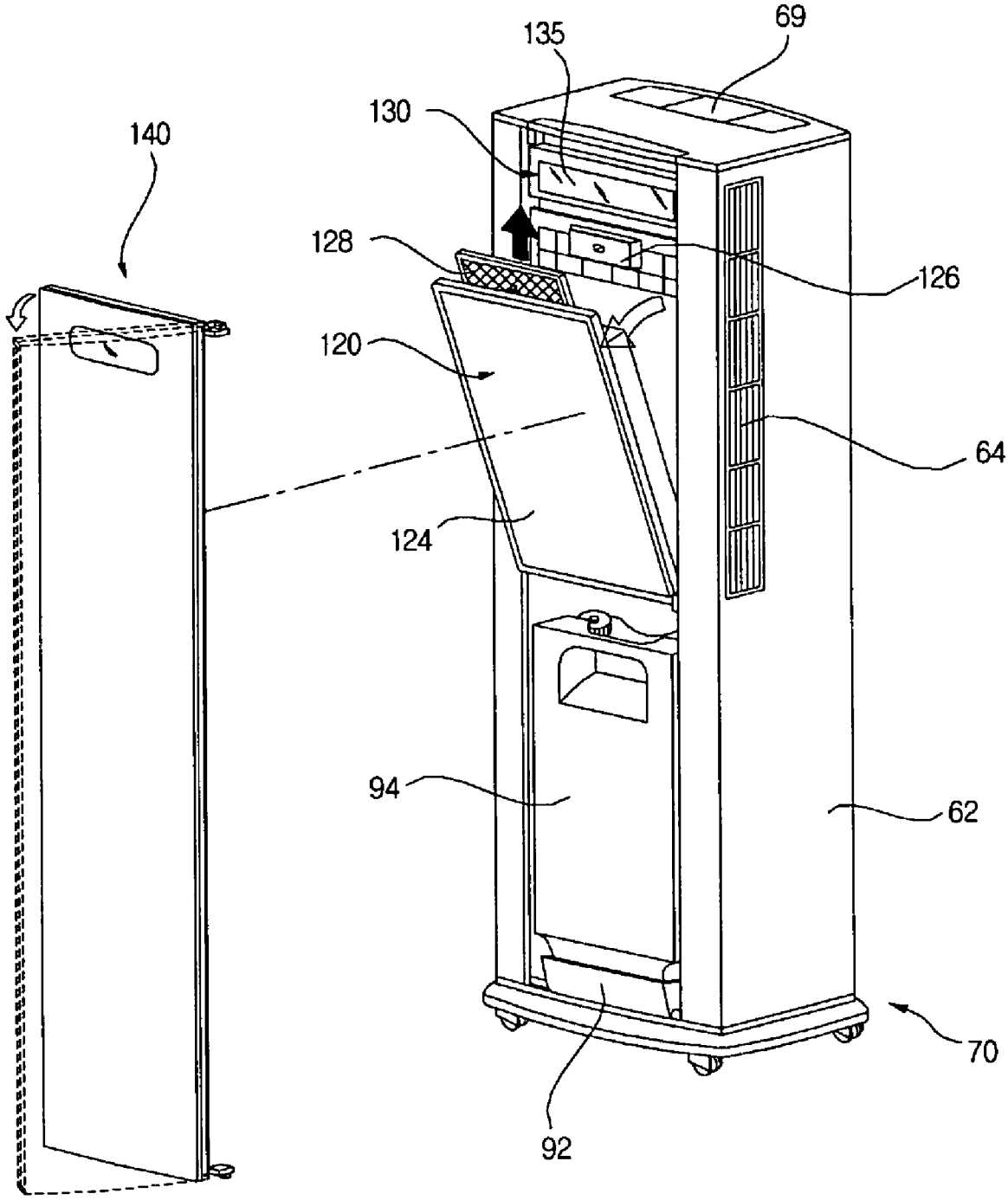

[Fig. 9]
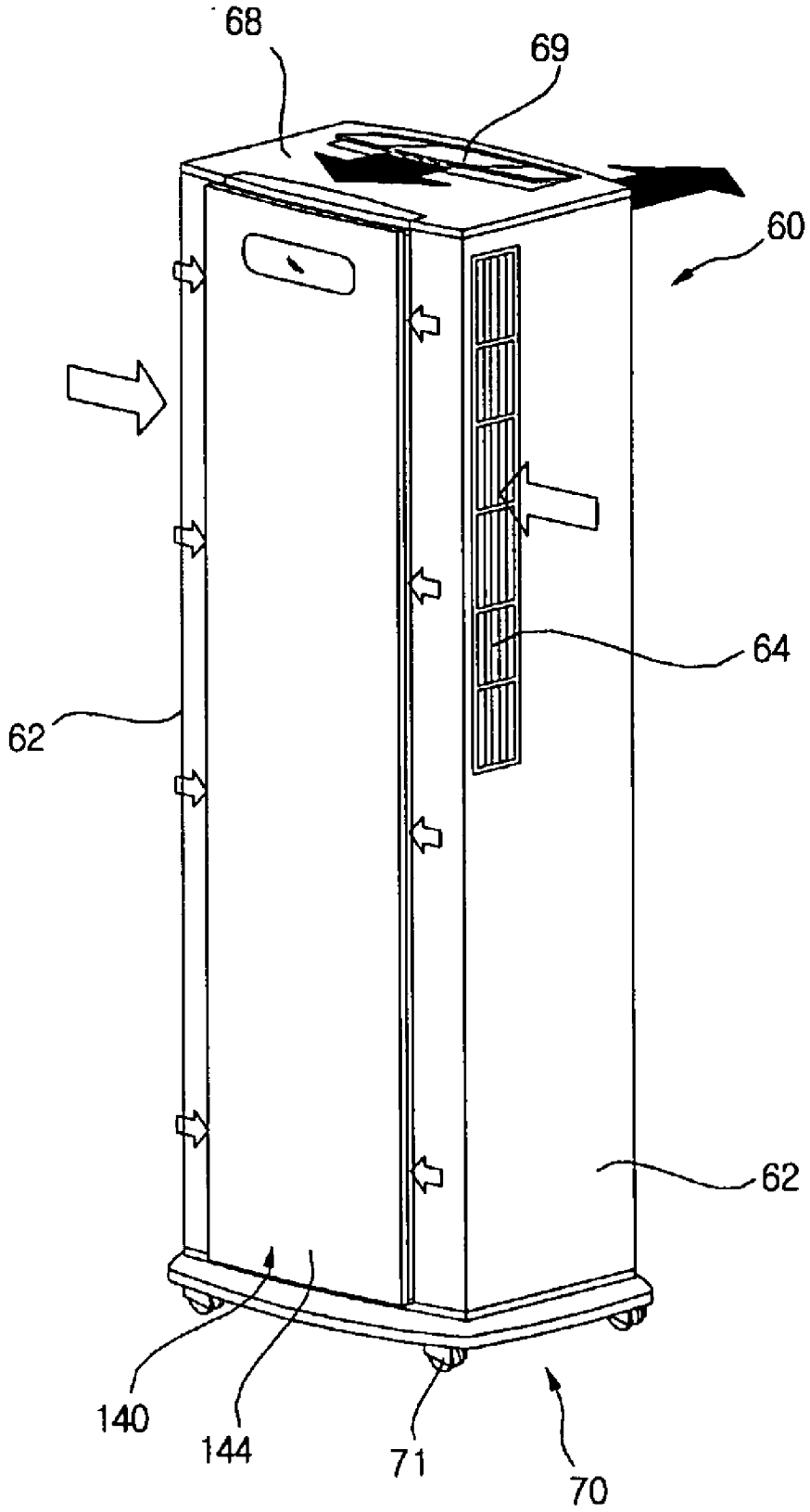

DEHUMIDIFIER

This application claims the benefit of PCT Patent Application No. PCT/KR2006/004503, filed Nov. 1, 2006, which claims the benefit of Korean Patent Application No. 10-2005-0103873, filed Nov. 1, 2005, and Korean Patent Application No. 10-2005-0105580, filed Nov. 4, 2005, which are all hereby incorporated by reference in their entirety.

TECHNICAL FIELD

The present invention relates to a dehumidifier, and more particularly, to a dehumidifier that can easily attach and detach a compressor to or from a barrier and fix a drain hose to the barrier.

BACKGROUND ART

Generally, a dehumidifier is an apparatus for sucking indoor humid air into a cabinet, removing moisture from the humid air by allowing the humid air to pass through a heat exchanger having a condenser and a vaporizer along which refrigerants flow, then discharging the air from which the moisture is removed to an indoor room.

The humidifier includes a cabinet provided with an air inlet and an air outlet, a heat exchanger having a vaporizer and a condenser for the dehumidification of air introduced, a compressor connected to the condenser for condensing the refrigerants, a drain pan disposed under the heat exchanger to collect the condensed water, a bucket disposed under the drain pan to store the condensed water flowing down from the heat exchanger.

When it is intended to discharge the condensed water without using the bucket, a drain hose is directly connected to a drain hole formed on the drain pan to drain the condensed water out of the dehumidifier.

According to the conventional dehumidifier, in order to discharge the water using the bucket, a device for fixing the drain hole which is not used is required.

In addition, when the condensed water is discharged using the drain hose, there is no device for properly controlling the movement of the drain hose.

When there is a need to have a maintenance service due to the malfunction of the compressor, the cabinet defining the outer appearance of the dehumidifier must be disassembled. This is troublesome for the user.

Furthermore, even when the cabinet is disassembled, since the compressor is surrounded by a variety of internal components, these internal components must be dismounted to separate the compressor.

DISCLOSURE OF INVENTION

Technical Problem

Accordingly, the present invention is directed to a dehumidifier that substantially obviates one or more problems due to limitations and disadvantages of the related art.

An object of the present invention is to provide a dehumidifier that can fix a drain hose which is not being used during discharging of condensed water stored in a bucket.

Another object of the present invention is to provide a dehumidifier that can prevent the drain hose from moving by flow of the condensed water during the discharging of the condensed water through the drain hose.

Still another object of the present invention is to provide a dehumidifier that can separate a compressor using a minimum working process by separating a small amount of internal components surrounding the compressor when there is a need to have a maintenance service due to the malfunction of the compressor.

Still yet another object of the present invention is to provide a dehumidifier that can mount a compressor using a minimum working process after the repair of the compressor is finished.

Technical Solution

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dehumidifier including: a base; a barrier installed on the base to divide front and rear portions of the base; a drain pan formed on an upper portion of the barrier to collect condensed water and provided with a water collecting hole through which the condensed water is discharged; a drain hose connected to the water collecting hole to discharge the condensed water; and a hose fixing unit formed on the barrier to fix the drain hose.

In another aspect of the present invention, there is provided a dehumidifier including: a base; a barrier installed on the base to collect condensed water and provided with a water collection hole for discharging the condensed water; a bucket assembly coupled to the barrier and storing the condensed water; a drain hose for discharging the condensed water to an external side, one of the bucket assembly and the drain hose being selectively connected to the water collecting hole; and a hose fixing unit for fixing the drain hose.

In still another aspect of the present invention, there is provided a dehumidifier including: a base; a compressor installed on a rear portion of the base; a barrier installed on a front portion of the base to collect condensed water and provided with a penetration portion used for mounting or separating the compressor; and a drain hose fixed on the barrier and discharging the condensed water collected in the barrier to an external side.

ADVANTAGEOUS EFFECTS

According to the present invention, the user can discharge the condensed water collected in a drain pan using any one of the bucket or the drain hose.

In addition, since the hose fixing unit for fixing the hose is formed on the barrier, the movement of the drain hose can be prevented when the condensed water is discharge through the drain hose and the drain hose can be stably fixed when it is not being used.

Furthermore, since the barrier is provided with a penetration portion, the compressor can be easily separated by separating only the bucket and the rear panel and inserting a tool through the penetration portion when there is a need to have a maintenance service due to the malfunction of the compressor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of a dehumidifier according to an embodiment of the present invention;

FIG. 2 is an exploded perspective view of the dehumidifier of FIG. 1;

FIG. 3 is an exploded perspective view of a bucket assembly according to an embodiment of the present invention;

FIG. 4 is a perspective view provided with a hose fixing unit according to an embodiment of the present invention;

FIG. 5 is a perspective view illustrating a separating process of a compressor from a base according to an embodiment of the present invention;

FIG. 6 is an operational view for illustrating a separating process of the bucket assembly according to an embodiment of the present invention;

FIG. 7 is an exploded perspective view of a filter assembly according to an embodiment of the present invention;

FIG. 8 is an operational view for illustrating a separating process of the filter assembly of FIG. 11; and FIG. 9 is a view illustrating an operation of the dehumidifier of the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 1 is a perspective view of a dehumidifier according to an embodiment of the present invention and FIG. 2 is an exploded perspective view of the dehumidifier of FIG. 1.

Referring to FIGS. 1 and 2, a humidifier of the present invention includes a cabinet 60 defining an outer appearance, a compressor 10 installed in the cabinet 60 and compressing refrigerants, a condenser 20 for condensing the refrigerants compressed by the compressor by heat-exchanging the refrigerants with air, an expansion valve 30 for expanding refrigerants condensed by the condenser 20, and a vaporizer 40 for vaporizing the refrigerants expanded by the expansion valve 30 by heat-exchanging the refrigerants with air, and a blower fan assembly 50 for forcedly directing the air into the cabinet.

The dehumidifier of the present invention further includes a base 70 formed a bottom of the cabinet 60, a barrier 80 vertically installed on the base 70 and dividing the base into front and rear portions, a bucket assembly 90 installed on the barrier 80 to store the condensed water condensed on a surface of the vaporizer, and a filter assembly 120 installed on an upper portion of the barrier 80 to filtering off foreign off foreign objects contained in air introduced into the cabinet 60 and directed to the blower fan assembly 50.

Describing in more detail, wheels 71 are installed on a bottom of the base 70 and the barrier 80 is installed on the base 70. With reference to the barrier 80, the bucket assembly 90 is installed on the front portion of the base 70 and the compressor 10 is installed on the rear portion of the base 70.

In addition, the filter assembly 120, vaporizer 40, condenser 20, and blower fan assembly 50 are installed on the barrier 80 from the front portion to the rear portion in this order.

Here, the vaporizer 40 and the condenser 20 are spaced apart from each other and integrally coupled to each other. In order for the condensed water condensed by the vaporizer 40 to be effectively collected at the barrier 80, a drain pan 83 is formed on a top surface of the barrier 80. The vaporizer 40 and the condenser 20 are mounted on the drain pan 83.

Furthermore, an installation unit 84 formed at a higher location that the drain pan 83 is formed on the top surface of the barrier 80 and the blower fan assembly 50 is mounted on the installation unit 84.

The blower fan assembly 50 includes a housing 52 installed on the barrier 80, a centrifugal pan 54 installed in the housing 52, a driving motor 55 for driving the centrifugal pan 54, and a housing cover 56 assembled with the housing 52 to guide air discharged from the centrifugal pan 54.

The housing 52 is provided with an air inlet 52*a* through which the air is sucked. The air accelerated by the centrifugal pan 54 after passing through the air inlet 52*a* is guided upward by the housing 52 and the housing cover 56.

The housing 52 divides an interior of the cabinet into front and rear portions so that the air introduced from the interior room can be directed to the centrifugal pan 54 through only an air inlet 52*a*.

Furthermore, the vaporizer/condenser 40/20 and the housing 52 are assembled with each other, and a control box 130 for controlling the humidifier is installed above the vaporizer/condenser 40/50 and the housing 5.

Meanwhile, the cabinet 62 includes a side panel 62 defining a side appearance, a rear panel 65 defining a rear appearance, a top panel 68 defining a top appearance, and a front panel assembly 140 defining a front appearance.

The side panel 62 is provided with an air inlet 63 through which the air is introduced. The rear and front panels 65 and 68 are provided with respective air outlet 66 and 68*a* through which the air is discharged.

A louver 64 for controlling an induction direction of the air is installed in the inlet 63 of the side panel 62 and louvers 67 and 69 for controlling a discharging direction of the air are installed in the respective outlets 66 and 68*a* of the top panel 68.

Here, the louvers 64 and 67 installed on the respective side and rear panels 62 and 66 are designed to be adjusted by a user. The louver 69 installed on the panel 68 is designed to be controlled by a controller or the user.

At this point, the louver 69 is connected to the top panel 68 by a fin 69*a* so that it can pivot upward and downward. A motor (not shown) or a power transmission mechanism (not shown) may be installed on the top panel 67 so that the louver 69 can pivot by the control unit.

Meanwhile, the front panel assembly 140 includes a front frame 142 connected to the side panel 62 to pivot frontward, and a front panel 144 installed on a front surface of the front frame 142 so that it can be exposed to the user.

The peripheries of the front panel 144 and the front frame 142 are spaced apart by a predetermined distance. Therefore, the indoor air can be introduced into the cabinet 60 through a gap formed between the peripheries of the front panel 144 and the front frame 142.

A panel guide 146 is interposed between the front panel 144 and the front frame 142 at upper and lower ends.

In order for the air flows toward the filter assembly disposed in rear of the front frame 142, the front frame 142 is provided with a plurality of holes 142*a* and slits 142*b*.

Furthermore, a bracket 145 is installed on an edge of the front frame 142 so that the front frame 142 can be connected to the side panel 62 by a hinge. The bracket 145 is formed at each of upper and lower ends of the side edge of the side panel 62 so that the front panel assembly 140 can be opened and closed in a hinge motion.

The following will describe the bucket assembly 90 according to an embodiment of the present invention.

FIG. 3 is an exploded perspective view of the bucket assembly.

Referring to FIG. 3, the bucket assembly 90 of this embodiment includes a bucket guide 92 hingedly connected to the base 70 to pivot frontward and a bucket 94 storing the condensed water and pivoting frontward together with the bucket guide 92.

That is, a pin-shaped hinge 92*a* protrudes from both ends of the bucket guide 92 and is coupled to the bracket 74 of the base 70. Therefore, the bucket guide 92 can pivot about the hinge 92*a*.

The bucket guide 92 includes first and second guide units 93*a* and 93*b* protruding upward to guide the accurate seating of the bucket 94.

Here, the first guide unit 93*a* is aligned with a groove 94*a* formed on a front-lower end of the bucket 94 and the second guide unit 93*b* is aligned with a groove 94*b* formed on a rear surface of the bucket 94.

The guide units 93*a* and 93*b* allows a water collecting hole (83*c* of FIG. 4) of the barrier 80 to be accurately aligned with an inflow hole 94*c* of the bucket 94.

In addition, a handle 95 is formed on an upper end of the bucket 94 so that the user uses the handle 95 when he/she intends to lift the bucket 94.

Therefore, when the user pulls frontward the handle 95 of the bucket 94, an upper end of the bucket 92*a* is pivoted frontward about the hinge 92*a*. Then, after the upper end of the bucket 94 moves out of a receiving portion (81 of FIG. 4) of the barrier 80, the user lifts the bucket 94 so that the bucket 94 can be completely separated from the bucket guide 92.

Here, although not shown in the drawing, the bucket guide 92 may be installed to be hingedly coupled to the barrier.

FIG. 4 is a perspective view of the barrier of the present invention.

Referring to FIG. 4, the barrier 80 of this embodiment includes a receiving portion 81 for receiving the bucket assembly 90, a drain pan 83 formed on an upper portion to collect the condensed water, an installation portion 84 formed in rear of the drain pan 83 to support the blower fan assembly 50.

That is, a water collection hole 83*c* through which the condensed water collected in the drain pan 83 is directed to the inflow hole 94*c* of the bucket 94. Here, the water collection hole 83*c* is formed at a location corresponding to the inflow hole 94*c* of the bucket 83.

In addition, the drain pan 83*c* is provided with a plurality of ribs 82 for guiding the condensed water collected in the drain pan 83 to the water collecting hole 83*c*.

Meanwhile, in the dehumidifier of the present invention, the condensed water flowing downward along a surface of the vaporizer 4 is discharged to the bucket assembly 90 or drained through a drain hose 85 through a continuous drain manner.

That is, when it is intended to discharge the condensed water to the bucket assembly 90 without using the drain hose 85, there is a need to provide means for stably fixing the drain hose 85 in the dehumidifier. In addition, when it is intended to drain the condensed water using the drain hose 85, there is a need to provide means for preventing the drain hose 95 from moving.

Therefore, a hose fixing unit 86 is formed on an inner surface 80*a* of the barrier 8 so that the drain hose 85 that is selectively separated from the water collection hole 83*c* can be fixed thereto.

In addition, a penetration hole 87 through which the drain holes 85 penetrates is formed on the inner surface of the barrier 8. Therefore, the drain hose 85 is connected to the external side through the penetration hole.

That is, the hose fixing unit 85 includes a pair of hook loops. A plurality of paired hook loops are provided in a vertical direction. That is, in a state where the drain hose 85 penetrates the barrier 80, the drain hose 85 is fixed vertically.

The hook loops faces each other with reference to the drain hose 85. An extreme end of each hook loop is rounded inward so that the drain hose 85 can be easily attached or detached.

That is, when the drain hose 85 is mounted, the hook loops encloses the drain hose 85. At this point, in order to effectively prevent the drain hose 85 from moving, a distance between the hook loops is equal to or greater that a diameter of the drain hose 85.

In addition, a hose coupling portion (not shown) to which the drain hose 85 is coupled is formed under the drain pan 83 to correspond to the water collection hole 83*c*.

That is, the hose coupling portion is formed in a cylindrical shape so that it can be inserted into the drain hose 85. At this point, an outer diameter of the hose coupling portion corresponds to an inner diameter of the drain hose 85 so that the hose coupling portion can be forcedly fitted in the drain hose 85.

In this embodiment, although the hose coupling portion is inserted into the drain holes 85, the hose coupling portion may be designed to enclose the outer surface of the drain hose 85. That is, the present invention is not limited to the present embodiment.

Here, the hose coupling portion is also connected to an inflow hole 94*c* of the bucket 94.

That is, the drain hose 85 is selectively connected to the bucket assembly 90 in a state where the bucket assembly 9 is fixed in the receiving portion.

FIG. 5 is a perspective view illustrating a separating process of the compressor from the base.

Referring to FIG. 5, as described above, the compressor 1 is installed on the base 7 in rear of the barrier 80.

A penetration portion 89 is formed on a center-lower end of the barrier 8 so that the compressor 10 can be easily separated and mounted.

That is, the penetration portion 89 is formed in a substantially rectangular shape. The penetration portion 89 is formed to correspond to a compressor installation base 11 to which a plurality of coupling members 11*a* are coupled to separate and mount the compressor 10 from or on the base 70.

Especially, the penetration portion 89 is formed to correspond to one of the coupling members 11*a*, which is close to the barrier 80. However, the location of the penetration portion 89 may vary according to a shape of the compressor installation base 11 provided on the compressor 10 and a method for installing the compressor installation base 11 on the base 70. The penetration portion 89 may be provided by plurality.

Accordingly, as shown in FIG. 5, according to an embodiment of the present invention, a triangular compressor installation base 11 is provided on the compressor 10 and one of the coupling members 11*a* may be position to close to a rear surface of the barrier 80. In addition, two of the coupling members 11*a* may be arranged to close the rear surface of the barrier.

Furthermore, the compressor installation base 11 may be formed in a rectangular shape and the coupling members 11*a* may be coupled to the respective corners of the compressor installation base 11 and the compressor installed base 11 may be installed on the base 70 while rotating little by little.

The following will describe the separating process of the bucket assembly 90.

FIG. 6 is an operational view for illustrating a separating process of the bucket assembly and FIG. 7 is an operational view for illustrating a separating process of the filter assembly.

Referring to FIG. 6, the user opens the front panel assembly 140 to empty the bucket 94 storing the condensed water. Then, the front panel assembly 140 rotates about the bracket 145 of the side panel 62 to open the cabinet 60.

In addition, the user pulls the handle 95 of the bucket 94 to separate the bucket 94 from the barrier 80.

That is, since the bucket 94 is disposed on the bucket guide 92 and the bucket guide 92 rotates in a state where the hinge 92*a* is connected to the barrier 80, the upper end of the bucket 94 pivots frontward by the user pulling the bucket 94.

As described above, as the user pulls the handle 95 of the bucket 94, the upper end of the bucket 94 is partly removed out of the barrier 80 to a location where the user can effectively lift the bucket 94. That is, when the user lifts the handle 95, the lower end of the bucket 94 is separated from the bucket guide 92.

Therefore, since the bucket 94 can be separated by the user grasping the handle at once, the separation of the bucket 94 can be conveniently realized.

Meanwhile, since the assembling of the bucket 94 is done in a reverse order, the detailed description thereof will be omitted herein.

The separating and coupling of the filter assembly 120 will now be described with reference to FIG. 8. The user opens the front panel assembly 140 and separates the filter case 124 from the filter frame 122.

In a state where the filter case 124 is coupled to the filter frame 122, an upper end of the filter case 124 is pressed. Then, the hook 127 is pushed rearward of the fixing member 126 and returned to release the hook fixing state. Therefore, the upper end of the filter case 124 pivots frontward. Then, the filter 128 received in the filter case 124 gets out of the filter case 124.

Meanwhile, when it is intended to couple the filter assembly 120, the filter 128 is inserted in the filter case 124 through the sliding motion. Next, the upper end of the filter case 124 is pushed toward the filter frame 122. Then, the hook 127 is inserted into the fixing member 126 and then hooked and fixed while being pushed by a predetermined distance frontward.

The following will describe the operation of the humidifier of this embodiment.

FIG. 9 is a view illustrating an operation of the dehumidifier of the present invention.

Referring to FIG. 9, when electric power is applied to the dehumidifier, the control unit installed in the control box 130 applies the power to the blower fan assembly 50 to introduce the indoor air into the cabinet 60 and discharge the introduced air to the room.

At this point, the indoor air is introduced through the air inlet 63 formed in the side panel 62, and the hole 142*a* and slit 142*b* formed in the front frame 142. The introduced air flows to the filter assembly 120 to filter off the foreign objects contained in the air.

Here, the foreign objects of the indoor air passing through the filter assembly 120 are filtered while the air passes through the filter 128. The air passing through the filter 128 is heat-exchanged with the vaporizer 40 after passing through the filter frame 122.

The filtered air heat-exchanges with discharge fins (not shown) formed on the vaporizer 40 and is thus cooled, in the course of which the moisture contained in the air is condensed on the surface of the vaporizer 40. The condensed water on the vaporizer 40 is collected in the drain pan 83 disposed on a lower portion of the vaporizer 40.

In addition, the air cooled while passing through the vaporizer is further heat-exchanged with the condenser 20 installed in rear of the vaporizer 40 to be heated again.

Here, since the condenser 20 emits heat during the condensing process of the vaporized refrigerants, the air from which the moisture is removed is heated to a temperature similar to that of the indoor air during the heat-exchanging process of the condenser 20.

After then, the air passing through the condenser 20 is guided to the housing 52 of the blower fan assembly 50. Then, the air guided into the housing 52 is accelerated by the centrifugal fan 54 installed in the housing 52 to be discharged to the room in a circumferential direction.

Here, the air discharged upward of the housing 52 is discharged to the room through the air outlet 69 formed on the top panel 68 and the air outlet 66 formed on the rear panel 65.

As described above, the dehumidifier of this embodiment sucks the air through the front and side surfaces and discharges the air through the top and rear surfaces. Therefore, the air can be directed in an every direction of the room in which the dehumidifier is installed.

Meanwhile, the control unit controls the air discharging direction and an amount of the air discharged by adjusting the rotational angle of the louver 69. Therefore, when the air is discharged upper-frontward of the cabinet 60, the louver 69 rotates rearward from the closed state to form the discharge hole frontward. When the air is discharged upper-rearward of the cabinet, the louver 69 rotates frontward from the closed state to form the discharge hole rearward.

Meanwhile, the condensed water condensed on the vaporizer 40 and collected in the drain pan 83 flows into the bucket 94 through the water collecting hole 83*c* of the drain pan 83.

Here, the dehumidifier of the present invention is designed to discharge the condensed water through the drain hose 85 other than the method using the bucket assembly 90.

When it is intended to discharge the condensed water using the drain hose 85, the drain hose 85 fixed on the hose fixing unit 86 is first pulled toward the water collection hole 83*c* and a first side of the drain hose 85 is connected to the hose coupling portion.

At this point, the rest portion of the drain hose 85 except for the first side is still fixed on the hose fixing portion so that the drain hose 85 cannot be moved by the flow of the condensed water.

That is, when it is intended to store the condensed water in the bucket, the drain hose 85 is separated from the hose coupling portion. When it is intended to continuously discharge the condensed water to the external side, the drain hose 85 is connected to the hose coupling portion.

Regardless of the discharge paths of the condensed water, the drain hose 85 keeps being fixed on the hose fixing portion 86, the position of the drain hose 85 can be fixed even when the condensed water flows along the drain hose 85 and an external impact is applied to the dehumidifier.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the dehumidifier of the present invention, the user can discharge the condensed water collected in the drain pan using selectively one of the bucket and the drain hose. In addition, when the condensed water is drained through the drain hose, the movement of the drain hose can be prevented. Furthermore, when the compressor malfunctions, the compressor can be separated by simply removing the bucket and the rear panel without disassembling the all of the inner components of the dehumidifier. Therefore, the industrial applicability of the present invention is very high.

The invention claimed is:

1. A dehumidifier comprising:

a base;

a barrier installed on the base to divide front and rear portions of the base;

a drain pan formed on an upper portion of the barrier to collect condensed water and provided with a water collecting hole through which the condensed water is discharged;

a drain hose connected to the water collecting hole to discharge the condensed water; and a hose fixing unit formed on the barrier to fix the drain hose.

2. The dehumidifier according to claim 1, further comprising a bucket assembly for storing the condensed water discharged from the water collecting hole, wherein one of the bucket assembly and the drain hose are selectively connected to the water collecting hole.

3. The dehumidifier according to claim 1, wherein a hose coupling portion to which the drain hose is coupled is formed on the barrier near the water collection hose.

4. The dehumidifier according to claim 1, wherein the barrier is provided with a penetration hole through which the drain hose penetrates.

5. The dehumidifier according to claim 1, wherein the hose fixing portion includes a plurality of paired hook loops that are spaced apart from each other by a predetermined distance.

6. The dehumidifier according to claim 5, wherein the paired hook loops are arranged along the barrier in a vertical direction.

7. The dehumidifier according to claim 5, wherein the hook loops face each other with reference to the drain hose.

8. The dehumidifier according to claim 5, wherein an extreme end of each hook loop is rounded inward.

9. The dehumidifier according to claim 1, wherein a compressor is installed in rear of the barrier and the barrier is provided with a penetration portion enabling the compressor to be easily installed.

10. A dehumidifier comprising:

a base;

a barrier installed on the base to collect condensed water and provided with a water collection hole for discharging the condensed water;

a bucket assembly coupled to the barrier and storing the condensed water;

a drain hose for discharging the condensed water to an external side, one of the bucket assembly and the drain hose being selectively connected to the water collecting hole; and a hose fixing unit for fixing the drain hose.

11. The dehumidifier according to claim 10, wherein the bucket assembly comprises a bucket guide connected to the base by a hinge and a bucket seating on the bucket guide and storing the condensed water, the bucket being provided with an inflow hole connected to the water collecting hole.

12. The dehumidifier according to claim 10, wherein a hose coupling portion to which one of the drain hose and the bucket assembly is selectively connected is formed under the water collecting hole.

13. The dehumidifier according to claim 10, wherein the barrier is provided with a receiving portion in which the bucket assembly is received and the drain hose is fixed in the receiving portion in a vertical direction.

14. The dehumidifier according to claim 10, wherein the drain hose is connected to an external side through the barrier.

15. The dehumidifier according to claim 10, wherein the hose fixing portion includes a plurality of paired hook loops that are spaced apart from each other by a predetermined distance.

16. The dehumidifier according to claim 15, wherein the paired hook loops are arranged along the barrier in a vertical direction.

17. The dehumidifier according to claim 15, wherein the hook loops encloses a part of the drain hose.

18. A dehumidifier comprising:

a base;

a compressor installed on a rear portion of the base;

a barrier installed on a front portion of the base to collect condensed water and provided with a penetration portion used for mounting or separating the compressor; and a drain hose fixed on the barrier and discharging the condensed water collected in the barrier to an external side.

19. The dehumidifier according to claim 18, further comprising a compressor installation base, on which the compressor is installed and which is installed on the base, wherein the compressor installation base is coupled to the base by a plurality of coupling members.

20. The dehumidifier according to claim 19, wherein the penetration portion is formed on a portion corresponding to one of the coupling member, which is close to the barrier.

* * * * *